United States Patent [19]

Salvador

[11] 4,239,820

[45] Dec. 16, 1980

[54] METHOD FOR CREATING A SIMULATED STONE SURFACE OR THE LIKE

[76] Inventor: Silvano E. Salvador, 20490 Melvin, Livonia, Mich. 48152

[21] Appl. No.: 875,531

[22] Filed: Feb. 6, 1978

Related U.S. Application Data

[63] Continuation of Ser. No. 702,505, Jul. 6, 1976, abandoned.

[51] Int. Cl.[3] ..... B05D 1/32; B05D 3/12; B05D 5/00

[52] U.S. Cl. ..... 427/272; 101/128.21; 101/129; 427/282

[58] Field of Search ..... 427/272, 282; 101/128.2, 129, 128.21; 249/15; 52/314

[56] References Cited

U.S. PATENT DOCUMENTS

| | | | |
|---|---|---|---|
| 278,238 | 5/1883 | Harding | 427/282 X |
| 2,383,913 | 8/1945 | Leander | 101/129 |
| 2,616,145 | 11/1952 | Dufford | 52/314 X |
| 3,177,279 | 4/1965 | Bilodeau | 52/314 X |
| 3,364,088 | 1/1968 | Seman et al. | 427/272 X |
| 3,712,825 | 1/1973 | Yocum | 427/261 X |

FOREIGN PATENT DOCUMENTS

| | | | |
|---|---|---|---|
| 677763 | 12/1964 | Italy | 52/314 |

*Primary Examiner*—Evan K. Lawrence
*Attorney, Agent, or Firm*—Everett R. Casey

[57] ABSTRACT

A method for creating a simulated stone pattern surface or the like on a surface area in which a pattern, provided with a plurality of irregular cutouts defined by a web of interconnected strip portions, is adhereable to a surface for removal after the application thereover of a settable plastic composition, to define mortar lines, with the pattern being rectangular and designed to mate, in a plurality of orientations, with other different patterns.

1 Claim, 6 Drawing Figures

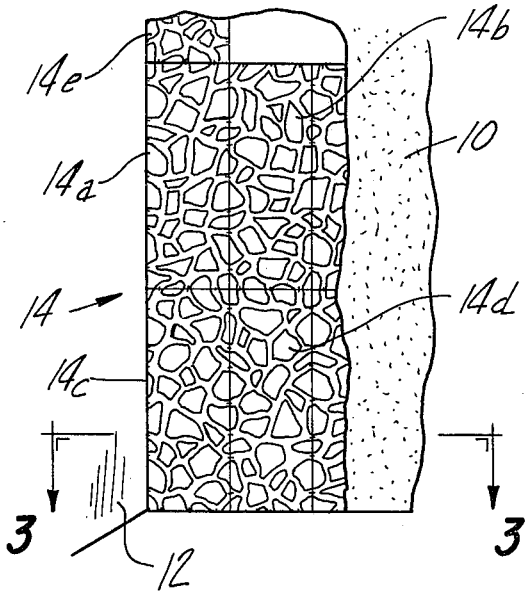
Fig-1
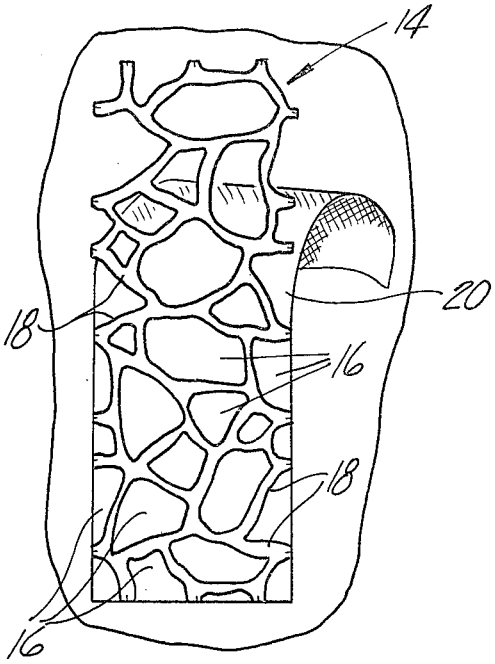
Fig-2
Fig-3
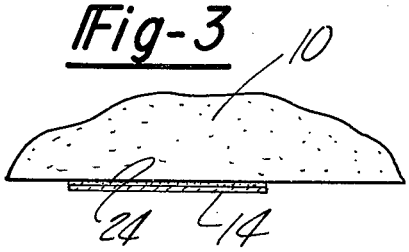
Fig-4
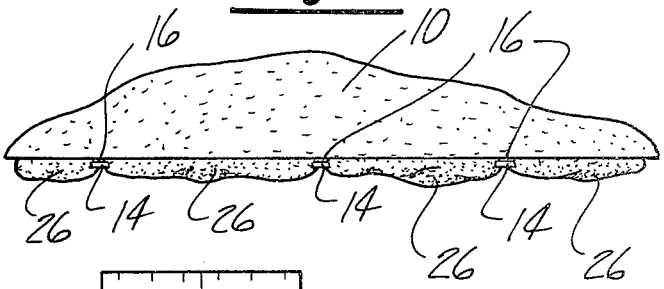
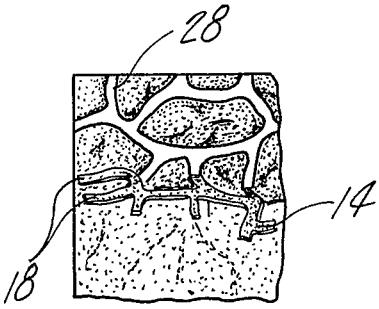
Fig-5
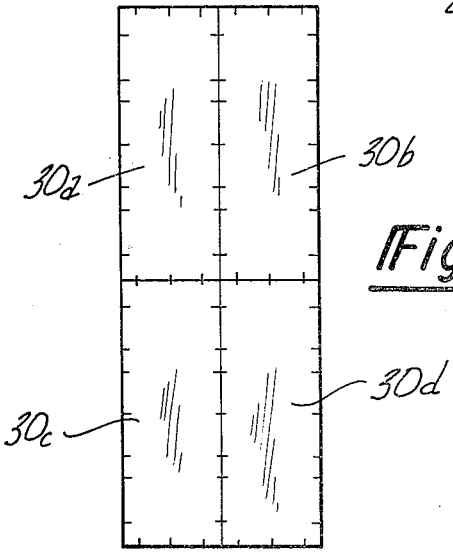
Fig-6

METHOD FOR CREATING A SIMULATED STONE SURFACE OR THE LIKE

This is a continuation of application Ser. No. 702,505, filed July 6, 1976, abandoned.

CROSS REFERENCES TO RELATED APPLICATIONS

A related patent application for Apparatus and Method for Creating a Simulated Brick Surface or the Like, Ser. No. 877,858, Feb. 15, 1978, abandoned; a design patent application for a Decorative Tape System Ser. No. 006,108, Jan. 24, 1979; and a design patent application for a Decorative Stone Pattern, Ser. No. 006,107, Jan. 24, 1979; have been filed by the same inventor.

BRIEF SUMMARY

This invention relates to a method for creating a simulated stone-pattern surface or the like on a surface area. In a known prior practice, a series of tape strips were applied to demark the mortar lines in a simulated brick surface. The taped surface was then coated with a suitable settable composition which, upon setting, gave the appearance of brick, with the tape being removed prior to setting.

The present invention simplifies the creation of a simulated stone pattern surface by providing an integral pattern to define mortar lines between simulated stones following the removal of the pattern subsequent to the application of a settable plastic composition thereover. A non-repetitive surface is achieved by utilizing a plurality of patterns differing from each other but mateable in a plurality of orientations.

BRIEF DESCRIPTION OF THE DRAWING

FIG. 1 is a perspective view of a wall of a room to a portion of which patterns embodying principles of the present invention have been applied in accordance with a method embodying principles of the present invention;

FIG. 2 is a front elevational view of a pattern used in the installation of FIG. 1, with a backing sheet partially peeled away;

FIG. 3 is a section taken substantially along the line 3—3 of FIG. 1;

FIG. 4 is a sectional view corresponding to FIG. 3 but following the application of a composition to the surface;

FIG. 5 is a fragmentary elevational view of a portion of the surface area of FIG. 1 following the application of a composition over the pattern and during the process of removal of the pattern; and FIG. 6 is a diagrammatic representation of the manner of achieving mateability, in a variety of orientations, of a plurality of different patterns.

DETAILED DESCRIPTION

The present system is designed to create a simulated fieldstone surface or the like. For example, FIG. 1 illustrates a room wall area 10 adjacent a side wall 12. After suitable preparation of the surface of wall 10 (to provide a clean solid surface, which may include the application of a priming coat), a group of patterns 14 are applied to the surface area. Each of the patterns 14 comprises a plurality of open areas, desirably of irregular form to simulate the shape of a stone, bounded by strips which will define variable sized mortar joints in the final surface. For example, in the view of FIG. 2, the illustrated pattern 14 consists of a plurality of openings 16 bounded (in part or fully) by interconnected narrow strip portions 18. To facilitate association of the pattern with the surface 10, in the preferred arrangement the pattern is coated on its reverse side with a pressure sensitive adhesive and backed with a removable backing paper 20 (FIG. 2), and the pattern is formed of treated paper with the markings delineating the areas 16 and the strips 18 being fully or majorly die cut through the paper so that they may be readily removed. The backing strip 20 is peeled from the pattern 14, which may be accomplished either prior to application of the pattern 14 to the wall 10 or by the technique of partially peeling off the backing, securing the pattern in the peeled area to the wall and then completing the peeling operation as the pattern is permitted to drop into adhering relationship with the wall surface. The solid areas of the pattern which are to form the openings 16 may be removed from the backing preliminary to the other steps, may be removed with the backing, by appropriate manipulation, or may be removed after the full pattern is adhered to the wall 10. The adherence of the pattern 14 to the wall 10 through the medium of glue or pressure sensitive adhesive 24 is illustrated in the cross sectional view of FIG. 3.

While the pattern is preferably of paper, it may be of other materials such as cardboard or plastic and may be as thick as desired, including, as an example, as thick as the depth of the proposed mortar line.

After the patterns are adhered in position, any suitable plastic settable composition 26 may be applied over the pattern-covered surface area 10. It is not necessary to apply material over the web strips 18, although it may be simpler to do so. The material is termed plastic in the sense that it can be readily molded and may be the consistency of a thin mortar or cake frosting. It should be appliable with a spatula or the like, and should not sag or run upon application. The material should be settable, in the sense of having the capacity to set or cure or harden to a rigid surface after the passage of a reasonable time. Any suitable material may be employed. For example, mixtures of limestone, mica, organic binders and thickeners and silica sand may be employed, mixed with water to a suitable consistency. The percentages can be varied widely. As one example, a mixture of 42% limestone, 6% mica, 2% organic binders (such as vinyls) and cellulosic thickeners and 50% silica sand, by volume, may be mixed with water to provide a suitable paste. Coloring may be added if desired, and different areas may be differently colored to simulate the variety of stones. Suitable mixtures are available on the commercial market and do not form a part of the present invention, the only requirement being that the material be applicable in a plastic state to the surface and that it subsequently satisfactorily harden or cure to provide a rigid surface.

The composition 26 may be applied in an appropriate thickness (such as 1/16 to ¼ inch more or less) and may be applied to an irregular thickness to better simulate the surface of the fieldstones, as is illustrated in the cross sectional view of FIG. 4 of the drawing.

After the composition has been applied, with or without partial setting, the pattern 14 with any composition overlying the strips 18 is peeled off of the wall and discarded, the removed strips 18 leaving a residual pattern 28 (FIG. 5) simulating the mortar joints or lines between the simulated fieldstone areas.

In the preferred arrangement, the entire wall pattern is made up of a group of separate and distinctive subpatterns, subpatterns 14*a*, 14*b*, 14*c*, 14*d* and 14*e* being illustrated in FIG. 1 of the drawing. Each pattern is rectangular and is arranged to mate side to side and end to end with each of the other patterns, regardless of whether each pattern is in one orientation or is rotated end for end. Thus, pattern 14*a* is illustrated as abutting and mating with pattern 14*b* in the sense that each of the constituent strip portions terminating along the left-hand edge of pattern 14*b* aligns with and serves as a continuation of a corresponding termination on pattern 14*a*, and the other patterns, while different, similarly coact.

The method of achieving that co-action is best illustrated in FIGS. 1 and 6 of the drawings. First, each of the strip portions which terminates at an edge of the pattern is of a constant width, such as $\frac{3}{4}$ of an inch, and that is true even though the patterns differ significantly in design from one another. Secondly, the locations at which the strip portions 18 terminate along one vertical (in the illustrated orientation) edge is the same for each of the patterns and are aligned (in a vertical sense) with the locations at which the strips 18 terminate along the second parallel edge of the patterns, to provide side-to-side mateability of the patterns. The same thing is true for the top and bottom edges, to provide end-to-end mateability of the patterns. Further, the locations along each of the edges of each of the patterns at which the strip portions 18 terminate are arranged symmetrically about the center line of each such edge, as may be noted with regard to patterns 30*a*, 30*b*, 30*c* and 30*d* in FIG. 6. Thus, each of the patterns 30*a* through 30*d* (FIG. 6) may be rotated 180° in its plane and it will still mate both side-to-side and end-to-end with each of the other patterns, whether they have been rotated or not, thereby increasing the variety of final stone patterns which may be created with a certain number of the cut-out patterns.

As one specific example, as illustrated, with a pattern 18 inches wide and 48 inches long (and they may, of course, be smaller or larger), one termination occurs at the center of each edge of the pattern. Two further terminations occur 6 inches to each side of center at each narrower edge of each pattern. Along the longer pair of edges of each pattern, terminations occur $7\frac{1}{2}$ inches each side of center, $11\frac{1}{2}$ inches each side of center, and $19\frac{1}{2}$ inches each side of center, all as examples.

It is to be understood that a variety of sizes and simulated patterns may be created within the principles and scope of the present invention.

What is claimed is:

1. The method of creating a simulated stone surface or the like on a surface area which comprises the steps of:

(a) preparing first and second rectangular patterns, each pattern having one adhesive side and having a series of interconnected mortar line simulating strip portions extending in a plurality of directions with open areas therebetween, said step of preparing including (i) partially die cutting sheet material to the desired pattern configuration while leaving the die-cut portions in place, (ii) coating the sheet material with said adhesive, and (iii) removing and discarding the die-cut portions of the sheet material other than the interconnected mortar line strip portions, each of said patterns having a plurality of the strip portions terminating with uniform widths at the edges of the rectangular pattern at each of a plurality of preselected locations, the distance between two adjacent ones of said locations along a first edge of said rectangular pattern differing substantially from the distance between at least two other adjacent ones of said locations along said first edge of said rectangular pattern, said locations along said first edge of said rectangular pattern having locations and spacings along said first edge from an edge perpendicular to said first edge the same as the locations and spacings along a second edge of said rectangular pattern parallel with said first edge, so that the unifrom width terminations of the strip portions along said first or second edges of each pattern are aligned into abutting mating relationship when the first or second edge of the first pattern abutts the first or second edge of the second pattern;

(b) adhering said first and second patterns in said mateable abutting relationship to the surface area by means of their respectiive adhesive sides; applying a plastic settable composition to the surface area overlying (c) at least the open areas of the first and second patterns; and (d) thereafter removing the first and second patterns from the surface area together with any of the composition overlying said mortar line strip portions.

* * * * *